US005810256A

United States Patent [19]

Perret

[11] Patent Number: 5,810,256

[45] Date of Patent: Sep. 22, 1998

[54] AIRLESS SPRAY HEAD WITH SOLIDS COMMINUTER

[76] Inventor: Robert Perret, 1828 Sequoia St., Orange, Calif. 92668

[21] Appl. No.: 740,021

[22] Filed: Oct. 23, 1996

[51] Int. Cl.[6] ..... B05B 15/02

[52] U.S. Cl. ..... 239/119; 239/288; 239/463

[58] Field of Search ..... 239/104, 106, 239/116, 119, 223, 224, 288, 461, 463, 498, 581.1, 600

[56] References Cited

U.S. PATENT DOCUMENTS

| | | | |
|---|---|---|---|
| 3,645,450 | 2/1972 | Calder | 239/116 |
| 3,752,400 | 8/1973 | Calder | 239/116 |
| 4,508,268 | 4/1985 | Gebreth, Jr. | 239/119 |
| 4,537,355 | 8/1985 | Calder | 239/119 |
| 4,611,758 | 9/1986 | Gebreth, Jr. | 239/119 |
| 4,635,850 | 1/1987 | Leisi | 239/119 |
| 4,715,537 | 12/1987 | Calder | 239/119 |
| 4,971,249 | 11/1990 | Tam et al. | 239/119 |
| 5,280,853 | 1/1994 | Perret, Jr. | 239/119 |
| 5,294,053 | 3/1994 | Perret, Jr. | 239/119 |

*Primary Examiner*—Andres Kashnikow
*Assistant Examiner*—Lisa Ann Douglas
*Attorney, Agent, or Firm*—Robert E. Strauss

[57] ABSTRACT

There is disclosed the combination of an airless spray head for spraying liquids under high pressure in which an orifice tip holder is positioned in the spray head to locate the orifice tip in a longitudinal through passage of the spray head body and a comminuter mechanism having a turbine mounted within a comminuter casing with a liquid flow header to direct the liquid flow across the turbine blades, causing rotation of the turbine wheel and a coaxially mounted comminuting member to comminute solids in the liquid being sprayed prior to discharge of the liquid to the orifice tip. In the preferred embodiment the comminuting member is a axially fluted cylinder mounted in a cylindrical comminuting chamber.

12 Claims, 7 Drawing Sheets

10
20
14
16
24
100
106
60
12
80
18
98
142
110
58
62
64
56
66
68
52
22
48
126
54
26
88
122
82
20
20'

FIGURE 5
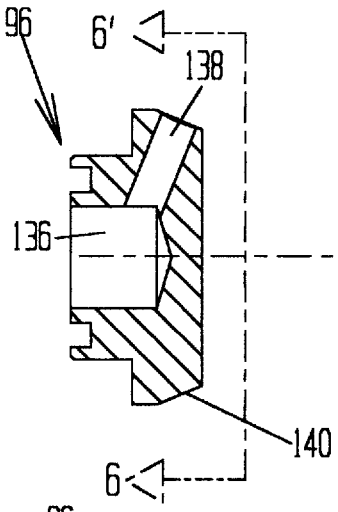
FIGURE 7
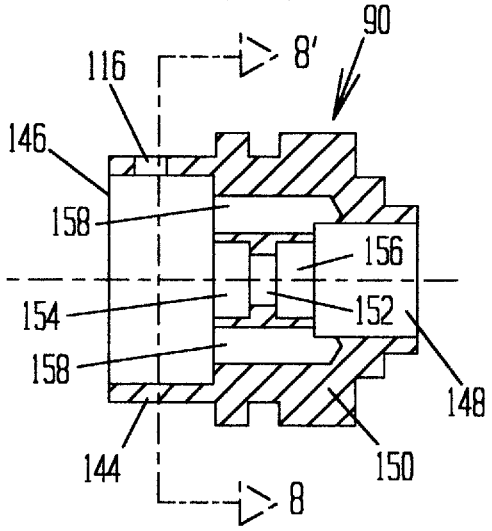
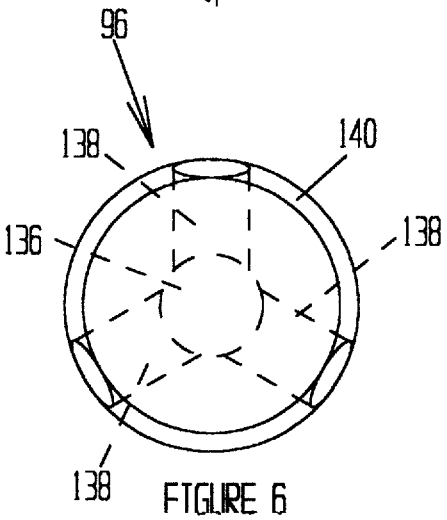
FIGURE 6
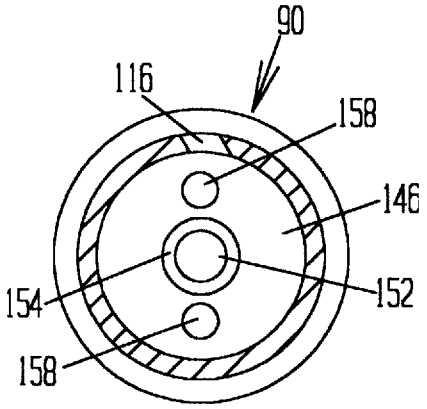
FIGURE 8

FIGURE 9
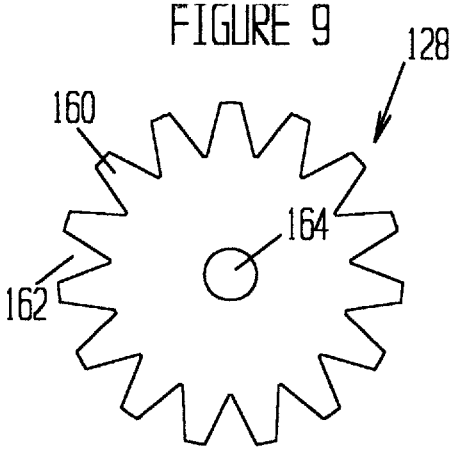
FIGURE 11
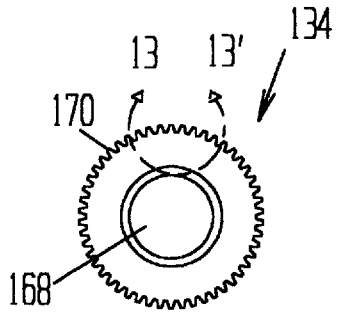
FIGURE 10
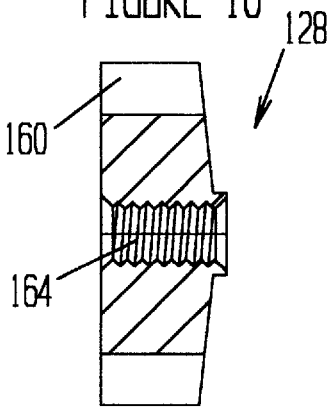
FIGURE 12
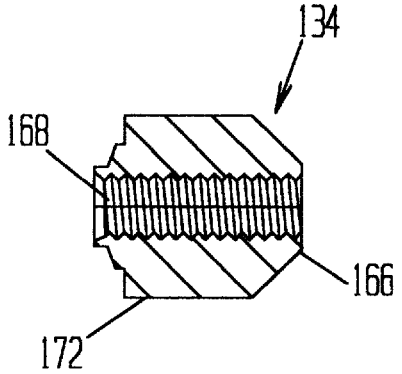
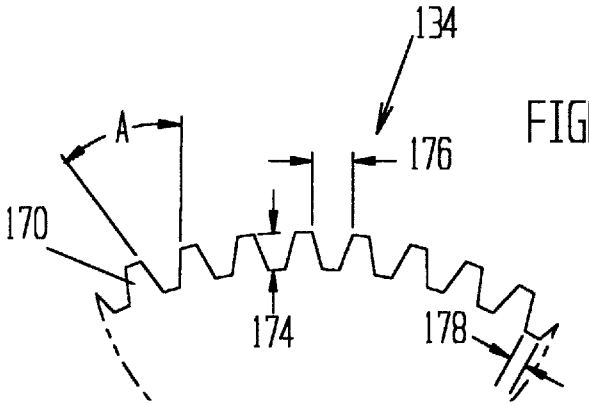
FIGURE 13

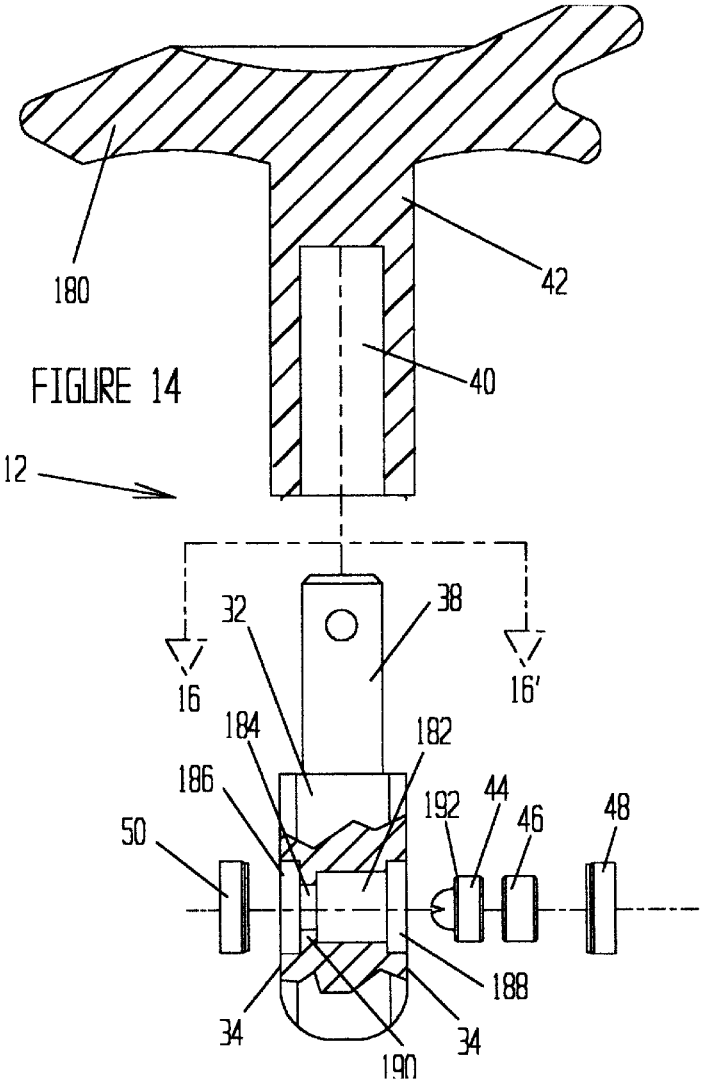
FIGURE 14
FIGURE 16
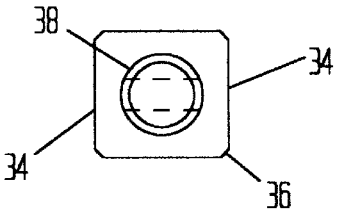
FIGURE 15
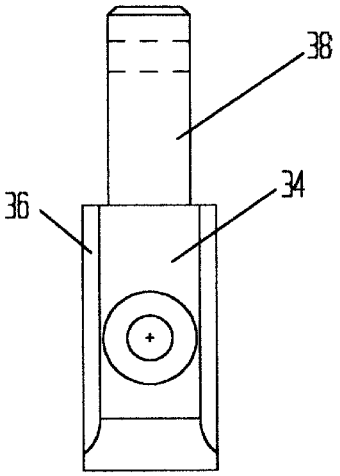

AIRLESS SPRAY HEAD WITH SOLIDS COMMINUTER

BACKGROUND OF THE INVENTION

1. Field of Invention

This invention relates to a spray head for airless spraying of liquids and, in particular, to a spray head having a solids comminuting mechanism.

2. Brief Statement of the Prior Art

The field of airless spray equipment used has been well established over many decades of use for spray painting. Typically, paints, stains, lacquers, etc., are sprayed at high pressures, usually from 2,000 to 5,000 pounds per square inch (PSI), through an orifice tip having a minute orifice with a shape that imparts a desired spray pattern to the discharge. Because of the abrasive nature of the liquid and the relatively high pressures employed, parts of the equipment such as orifice tips are exposed to highly abrasive conditions, and are formed of very high wear-resistant material, e.g., tungsten carbide and the like.

The orifices of the orifice tips typically have diameters from 0.009 to 0.055 inch, and great care must be taken to eliminate oversized solids from the spray liquid. Airless pump manufacturers commonly recommend multiple filtrations of liquid paint. These include filtering the paint as it is poured from the supply container into the sprayer reservoir, use of filters on the suction and discharge lines of the sprayer pump and use of a filter in the spray gun. Such multiple filtrations are tedious and the filters rapidly clog and interrupt the spray painting. Consequently, painters frequently use only the filter contained within the spray gun. This limited filtration is not entirely adequate and the orifice tips frequently clog and require cleaning to continue spraying.

A universal approach to the perennial problem of orifice clogging in the airless spray industry has been to mount the orifice tip in a holder which can be reversed, usually by rotation, within the spray head, thereby permitting application of the pressured spray liquid to blow solid obstructions from the orifice tip. The following patents are representative of the development of the art of rotatably reversible orifice tip holders: 5,294,053; 5,280,853; 4,971,249; 4,715,537; and 4,611,758. Because the liquid will discharge as a jet under relatively high pressures when blowing obstructions from the orifice, safety concerns have resulted in the design of spray tip heads with spray guards to prevent placing one's finger in the path of the liquid jet. Another innovation which has been used commercially comprises stepping the diameter of the passageway communicating with the orifice tip member to provide a small diameter orifice in the cleaning position. Other techniques which have been used for a similar result include positioning a diffuser pin (see U.S. Pat. No. 4,508,268) or other obstruction in the tip to break up a coherent liquid jet and cause the liquid to atomize into a safe, dispersed spray; or the use of an internal expansion chamber within the orifice tip holder assembly as shown in U.S. Pat. No. 5,294,053.

The aforementioned approaches don't eliminate the clogging problem; they only attempt to treat the symptom of the problem. Even at its best, these approaches interrupt the spraying operation, and waste the spray liquid required to blow solid obstructions from the orifice tip.

Prior attempts have been made to abrade solids present in the spray liquid by positioning an orifice in the flow path of the spray liquid and mounting in the orifice, a fluted or surface roughened mandrel under the resilient bias of a compression spring; see U.S. Pat. Nos. 3,645,450 and 3,752,400. The devices of these patents relied on-fluctuations in the liquid pressure, caused by the solids obstructions, to move the mandrel and abrade solids in the liquid passing through the orifice. This approach was never commercially successful.

Sealing of the multiple moving components of an airless spray head has presented a challenge to the industry. A number of patents have been granted on seals, such as the hand-tight, rotatable head seals of U.S. Pat. No. 4,537,355 and the floating piston seal of U.S. Pat. No. 4,715,537.

OBJECTIVES OF THE INVENTION

It is an objective of this invention to provide an improved spray head for airless spraying of liquids.

It is an additional objective of this invention to provide a spray head for airless spraying of liquids which includes a solids comminuter.

It is a further objective of this invention to provide a spray head for airless spraying of liquids having a solids comminuter with a liquid driven motor.

It is yet another objective of this invention to provide a spray head for airless spraying of liquids having a greatly reduced tendency for clogging.

It is also an objective of this invention to provide to a spray head for airless spraying of liquids which operates at turbulent or near turbulent flow conditions.

It is likewise an objective of this invention to provide a spray head for airless spraying of liquid which provides for extended life of wear sensitive materials such as orifice tips and the like.

It is another objective of this invention to provide a spray head for airless spraying of liquids having a more homogeneous and improved spray pattern.

It is likewise an objective of this invention to provide a spray head for airless spraying of liquids which reduces the filtration requirements of liquids prior to spraying.

It is yet an additional objective of this invention to provide a spray head for airless spraying of liquids having a spray guard with an improved venturi action.

It is a further objective of this invention to provide a spray head for airless spraying of liquids which can be rotated on the spray gun for proper orientation for the spray pattern without disassembly or loosening of its assembly to the spray gun.

It is a still further objective of this invention to provide a spray head for airless spraying of liquids which is useful with smaller spray orifices than commonly used in airless spraying.

It is an additional objective of this invention to provide a spray head for airless spraying of liquids which permits use of smaller pumps than commonly used in airless spraying.

It is an added objective of this invention to provide a spray head for airless spraying of liquids which permits use of smaller pumps than commonly used in airless spraying.

It is another added objective of this invention to provide a spray head for airless spraying of liquids which is useful with liquids having high viscosities.

Other and related objectives will be apparent from the following description of the invention.

BRIEF STATEMENT OF THE INVENTION

This invention comprises the combination of an airless spray head for spraying liquids under high pressure in which an orifice tip holder is positioned in the spray head to locate the orifice tip in a longitudinal through passage of the spray head body and a comminuter mechanism having a turbine mounted within a comminuter casing with a liquid flow header to direct the liquid flow across the turbine blades, causing rotation of the turbine wheel and a coaxially mounted comminuting member to comminute solids in the liquid being sprayed prior to discharge of the liquid to the orifice tip. In the preferred embodiment the comminuting member is a axially fluted cylinder mounted in a cylindrical comminuting chamber.

BRIEF DESCRIPTION OF THE DRAWINGS

The invention will be described with reference to the figures of which:

FIG. 5 is a sectional view of the liquid flow diverter used in the invention;

FIG. 6 is a view along line 6–6' of FIG. 5;

FIG. 7 is a sectional view of the motor and comminuter casing used in the invention;

FIG. 8 is a view along line 8–8' of FIG. 7;

FIG. 9 is an end view of the turbine wheel of the turbine used in the invention;

FIG. 10 is a view along line 10–10' of FIG. 9;

FIG. 11 is an end view of the comminuter cylinder used in the invention;

FIG. 12 is a view along line 12–12' of FIG. 11;

FIG. 13 is a an enlarged view of the area within line 13–13' of FIG. 11;

FIG. 14 is an exploded view in partial section of the orifice holder assembly;

FIG. 15 is a view of the rear of the assembled orifice tip holder;

FIG. 16 is a top view of FIG. 15;

DESCRIPTION OF PREFERRED EMBODIMENT

Figure 1:
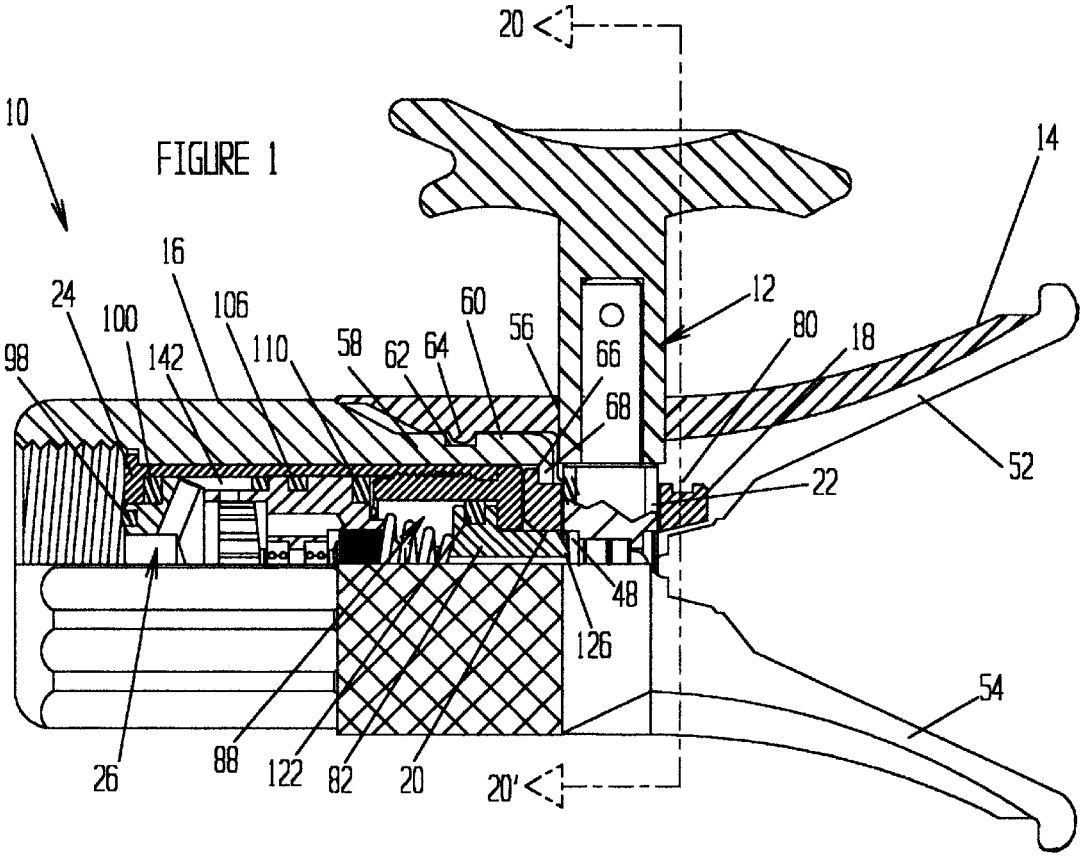
FIG. 1 is a partial sectional elevational view of the spray head of the invention.

Referring now to FIG. 1, there is illustrated the spray 10 head of the invention which is useful for airless spraying of liquids. As there illustrated, the upper half of the spray head 10 is shown in sectional view. The spray head 10 has the major components of an orifice holder assembly 12, a spray guard 14 and a nozzle retainer 16. The nozzle retainer 16 surrounds a spray head body 18 having a through passage 20 and an orthogonal intersecting passage 22 which receives the orifice holder assembly 12. The spray head 10 also includes a housing 24 in which are mounted a turbine and comminuter assembly 26 and a seal assembly 88 with a seal 82 projecting from the forward end of the assembly 26. The liquid flow passage into and through the spray head is sealed with a number of annular seals 98, 100, 106, 110 and 122, all described in greater detail hereafter.

Figure 2:
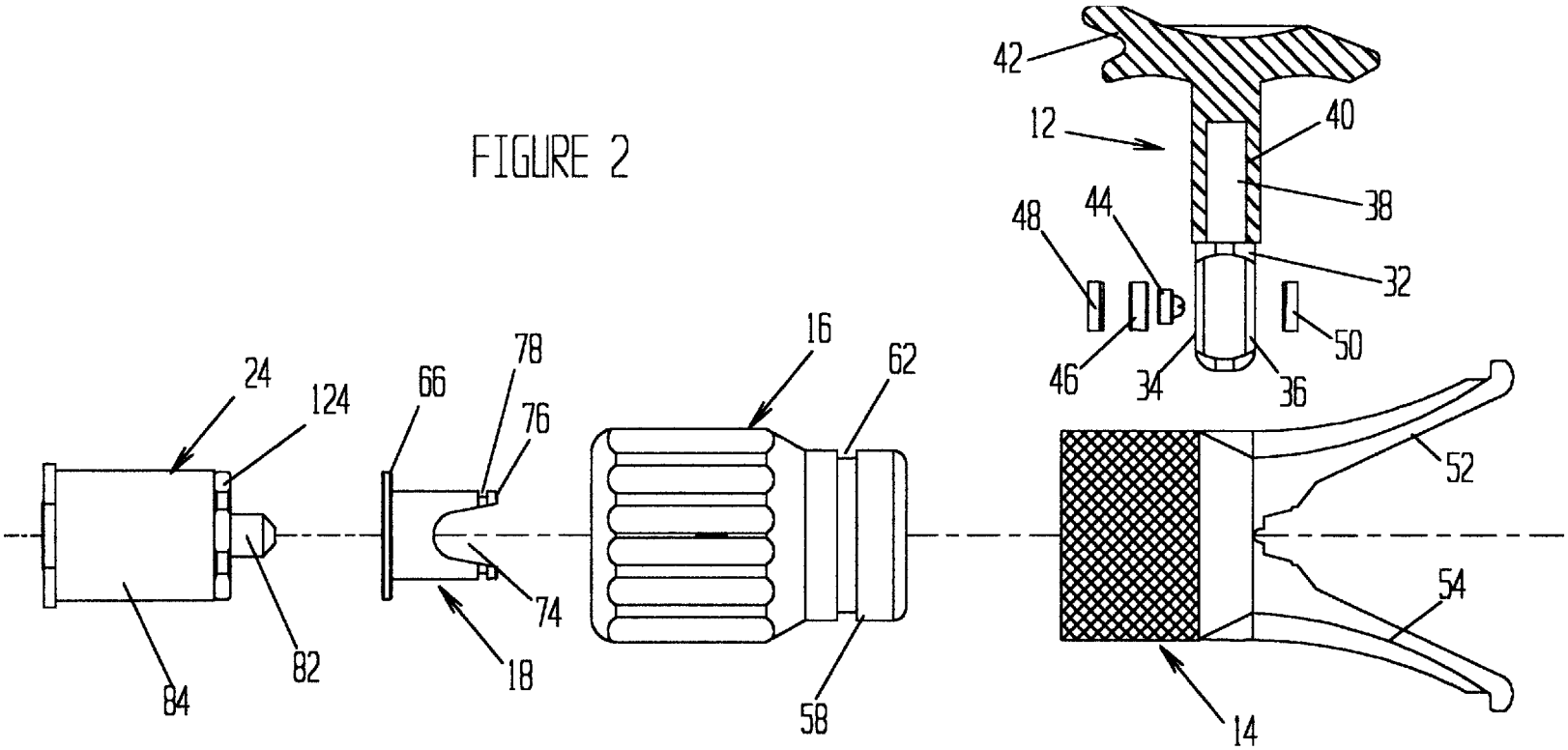
FIG. 2 is an exploded diagram of the major components of the spray head of the invention.

Referring now to FIG. 2, the major components of the spray head 10 are shown in exploded view. As there illustrated, the orifice tip holder 32 is formed of a generally square bar with flat faces 34 and rounded edges 36. The orifice holder assembly 12 includes handle 42 which has a cylindrical recess that permanently receives the upper cylindrical end 38 of the bar. The components of the orifice tip assembly are shown in exploded view and comprise an tip orifice tip 44, a retainer ring 46 and seal washers 48 and 50. The orifice holder assembly 12 and its components are shown in greater detail in FIGS. 14–16.

The spray guard 14, which is described in detail with reference to FIGS. 17–19 hereof, has a pair of diverging wings 52 and 54 and has a central cavity 56 (see FIG. 1) that receives the orifice holder assembly 12. The spray guard has a longitudinal chamber 60 (see FIG. 1) which is received over the forward end 58 of the retainer 16. The retainer 16 comprises an externally fluted, internally threaded retaining nut adapted for threadable engagement with the discharge barrel of a conventional spray gun. The forward end 58 of the retainer 16 has an annular groove 62 for seating an internal rib 64 of the spray guard; see FIG. 1.

The spray head body 18 is a tubular member having an annular flange 66 which is captured by the end flange 68 of the retainer 16; see FIG. 1. Also as apparent on FIG. 1, the spray head body 18 has a longitudinal through passage 20 which is intersected by an orthogonal passage 22 which receives the rod body of the orifice tip holder 32. The forward face of the spray head body has a beveled, arcuately bottomed groove 74 corresponding to the diverging spray characteristics of the orifice tip. Preferably, the discharge end 76 of the spray head body 18 has an annular groove 78 in which is seated an internal rib 80 on the inside of the spray guard (see FIG. 1), enhancing the permanent attachment of the spray guard 14 in the spray head 10.

The spray head housing assembly 24 includes the turbine and comminuter assembly 26 and the seal assembly 88, which are described in greater detail with reference to FIG. 3. These assemblies are contained in a cylindrical housing 84 which is closed with a retaining sleeve 124.

Figure 3:
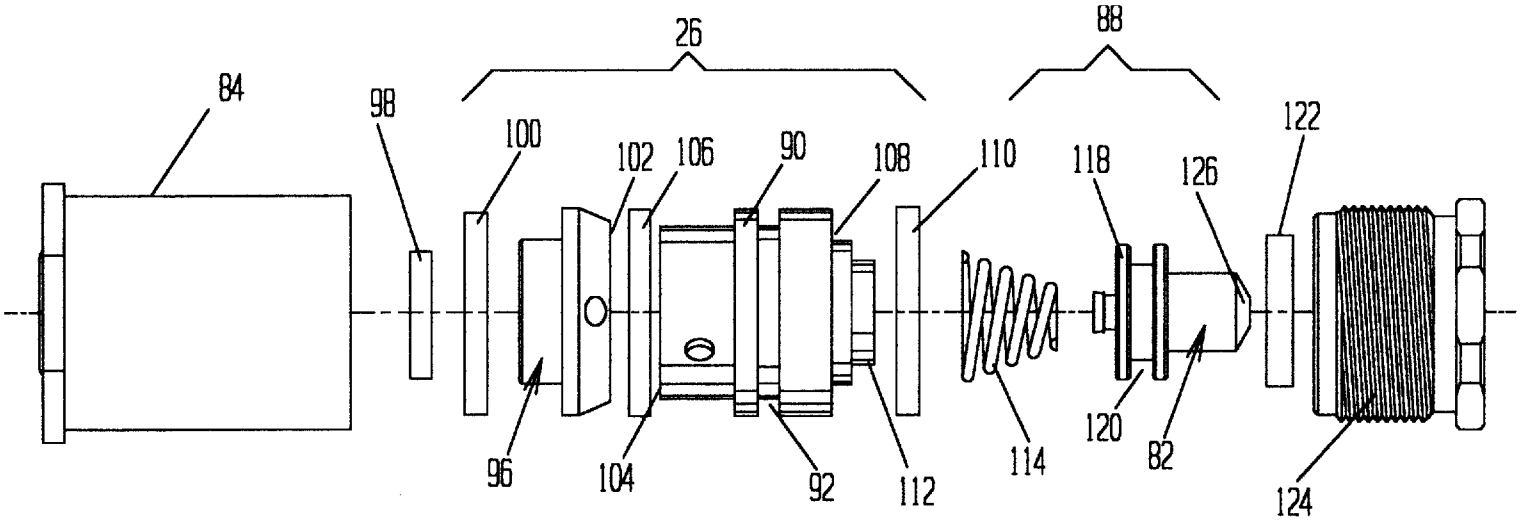
FIG. 3 is an exploded view of the comminuter and turbine assembly of the invention.

Referring now to FIG. 3, the housing assembly 24 of the spray head is illustrated with its components in exploded view. As there illustrated, the housing 84 contains a liquid flow diverter 96 which is shown in greater detail in FIGS. 5 and 6. The flow diverter 96 is sealed in the assembly with an annular end face seal 98 and an annular seal 100 that engages the internal walls of the housing 84. The end face 102 of the flow diverter 96 is received against the end face 104 of the turbine and comminuter casing 90. The casing 90 has an external cylindrical shape with an annular groove 92 for seating of a seal ring 106 and a forward face with stepped diameters to provide an annular shoulder 108 to receive a second seal ring 110 and to provide a cylindrical boss 112 that serves as a retainer for helical coil spring 114 that assists the sealing of the floating piston seal 82 in the spray head assembly. The seal 82 has a cylindrical piston 118 with an annular groove 120 to receive a piston ring seal 122 which seals against an internal cylindrical wall of the housing retainer sleeve 124. As shown in FIG. 1, the forward end 126 of the floating piston seal 82 projects into the body 18 of the spray head and into engagement with the resilient annular seal washer 48 of the orifice tip holder assembly 12.

Figure 4:
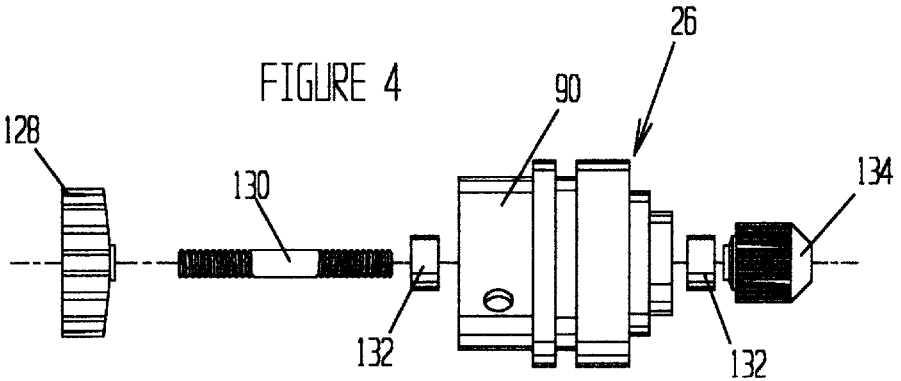
FIG. 4 is an exploded view of the turbine assembly of the spray head of the invention.

Referring now to FIG. 4, the component parts of the comminuter and turbine assembly 26 of the invention are illustrated in exploded view. The assembly 26 is contained within a comminuter and turbine casing 90 which is shown in sectional view in FIG. 7. The turbine and comminuter casing 90 receives a turbine wheel 128 that is threadably mounted on the end of shaft 130 which is supported in the assembly by a pair of ball bearing races 132. The comminuter wheel 134 is mounted on the opposite end of the shaft 130 which can be threaded with opposite, left and right hand threads on each end to receive the turbine wheel 128 and comminuter wheel 134. Alternatively, the comminuter wheel can be permanently mounted on the end of shaft 130 by press or shrink fit.

Referring now to FIG. 5, the flow diverter 96 is shown in sectional view. The flow diverter 96 is a circular disk having a central discontinuous bore 136 which is intersected by a plurality, preferably three, radial passages 138; see also FIG. 6. The forward face of the diverter 96 is beveled and the radial passages 138 extend orthogonally from the beveled edge surface 140, intersecting the central discontinuous bore 136. In this manner, liquid entering the spray head housing is diverted into an annulus 142 (see FIG. 1) surrounding the turbine end of the turbine and comminuter casing 90. This annulus 142 is formed by a reduced external diameter of the casing 90 surrounding the turbine wheel as shown in FIGS. 1 and 7.

Referring now to FIG. 7, the turbine and comminuter casing 90 is illustrated in sectional view. The turbine end 144 of the casing 90 has a reduced external diameter thereby forming the annulus 142 previously mentioned with regard to FIG. 1. The casing 90 has a large diameter chamber 146 for housing the turbine wheel 128 and a reduced diameter forward chamber 148 that provides a comminuting chamber in which is received the comminuting wheel 134. The central portion 150 of the casing 90 has a concentric through bore 152 with first and second counterbores 154 and 156 that provide seats for the bearing races 132 that rotationally support the shaft 130 of the turbine and comminuter assembly. Liquid communication is established between the turbine chamber 146 and the comminuting chamber 148 by a pair of passages 158 located at 180° angular increment spacing (see FIG. 8) which extend from the inside face of the turbine chamber 146 to the inside face of the comminuting chamber 148. The casing 90 is provided with a single inlet port 116 which opens to the turbine chamber 146. Preferably, this port 116 is inclined at an acute angle to a radial of the chamber (see FIG. 8) to provide a rotational momentum to the liquid entering the turbine chamber 146 and to direct the liquid against the blades of the turbine wheel.

Referring now to FIGS. 9 and 10, the turbine wheel 128 is illustrated in end and sectional views. The turbine wheel 128 is formed with a plurality of axial grooves spaced at equal angular increments about its circumference, forming axial ribs which serve as turbine blades 160. Each turbine blade 160 is separated by a slot 162 having an included angle from 45° to 90°, preferably 60°, from the next adjacent turbine blade. The turbine wheel has a central, internally threaded bore 164 to be received on the threaded end of the shaft 130 of the turbine and comminuter assembly 26.

Referring now to FIGS. 11–13, the comminuter wheel 134 is illustrated. The comminuter wheel 134 has a forward face 166 that is chamfered at 45° and can have an internally threaded central bore 168 for threadable engagement on the threaded end of the shaft 130. The external surface of the cylindrical comminuting wheel is roughened, preferably in the form of axial flutes 170 which extend the length of the cylindrical portion 172 of the comminuting wheel 134. As shown in FIG. 13, the flutes 170 have an included angle A from 20° to 45°, preferably 37°, and a depth 174 from 0.02 to about 0.05, preferably about 0.024, inch.

The internal diameter of the comminuting chamber is in close tolerance to the external diameter of the cylindrical portion of the comminuting wheel, i.e., within the tolerance of 0.001 to about 0.004 inch. The maximum spacing 176 between opposite faces of the grooves forming the flutes 170 is, in the preferred embodiment, 0.012 inch and the minimum spacing 178 at the bottom of the grooves is approximately half that distance. As all the liquid passing the spray head must pass through the grooves of the fluted cylindrical surface, the flutes 170 provide an abrading or comminuting action on any solids suspended in the liquid that insures that solids passing through the comminuter are reduced in size to particle diameters no greater than approximately 0.010 inch.

Referring now to FIGS. 14–16, the orifice holder assembly 12 is shown. The handle 42 has a forward prong 180 useful to indicate the direction of the spray from the orifice tip 44 and has a central recess 40 in its cylindrical shank that receives, in a permanent fit, the upper end 38 of the orifice tip holder 32. The orifice tip holder 32 is preferably metallic and generally rectangular with forward and rear, flat faces 34. The holder 32 has a transverse passage 182 which has a reduced diameter central portion 184 that intersects, at opposite ends, enlarged diameter portions 186 and 188. The forward end of the reduced diameter central portion 184 has an annular lip 190 which serves as a retention stop against is seated the forward face 192 of the orifice tip 44. The orifice tip 44 is secured within the passage 182 by a retainer ring 46 and resilient annular seals 48 and 50 are pressed into the enlarged diameter portions 186 and 188 on the opposite faces 34 of the orifice tip holder 32. As shown in FIG. 1, these annular resilient seal washers are engaged by the tapered end 126 of the floating piston seal 82 thereby providing sealing the liquid as it passes into the orifice tip 44 of the spray head 10.

Figure 17:
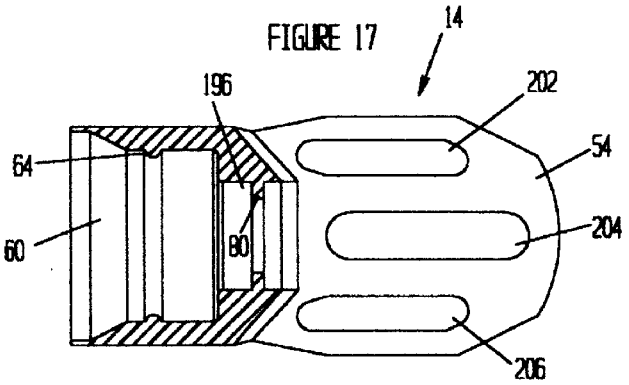
FIGS. 17–19 are views of the spray guard used in the spray head of the invention.
Figure 18:
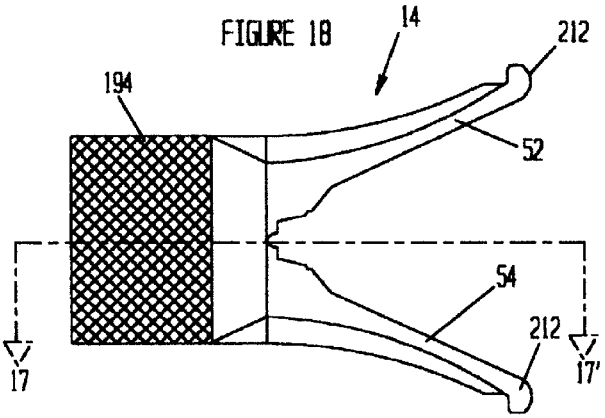
Figure 19:
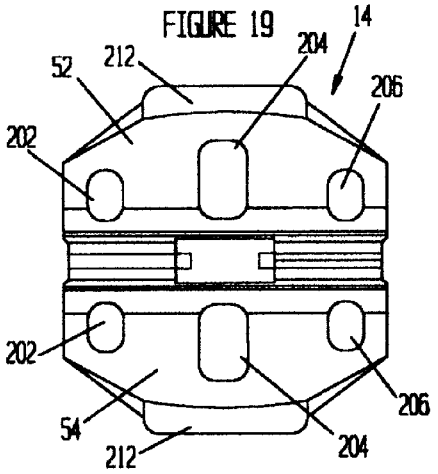

The spray guard 14 is shown in FIGS. 17–19. The spray guard 14 has a generally cylindrical body 194 with integral diverging flat wings 52 and 54. The cylindrical body 194 has a central longitudinal chamber 60 with a reduced diameter end 196 which has an internal annular bead 80 that seats in an annular groove of the spray body 18, as previously described with reference to FIG. 1. The central longitudinal chamber 60 of the spray guard 14 has an internal annular bead 64 that is received in an annular groove of the retainer 16 of the spray head, as previously described with regard to FIG. 1. These beads permanently lock the spray guard 14 to the body 18 and retainer 16 of the spray head 10.

Figure 20:
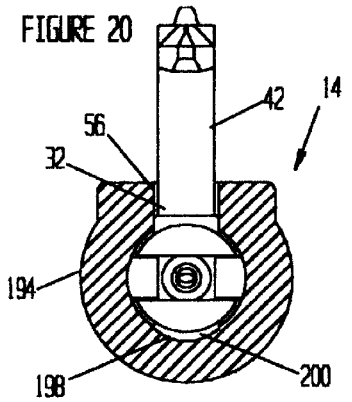
FIG. 20 is a view along line 20–20' of FIG. 1.

The spray guard also serves to provide an axial alignment of the orifice tip holder in the assembly, as the orthogonal passage 56 is discontinuous, forming an axial stop 198 which is engaged by the lower end 200 of the orifice tip holder 32 in the assembly; see FIG. 20.

The flat wings 52 and 54 of the spray guard 14 have an included angle of 45 to 120 degrees, preferably about 90 degrees, and a plurality of longitudinal slots 202, 204 and 206 in each wing to provide a desirable venturi action. The forward edges 212 of the wings 52 and 54 can be upturned to improve the characteristics of the spray from the spray head.

The invention provides the advantages of greatly reduced maintenance problems and lengthy continuous operations without interruptions for reversal of the orifice tip holder to remove clogs from the orifice tip. Instead, the turbine and comminuter assembly is highly effective in the reduction in solids contained in the liquid such that little or no clogging of the orifice tip occurs. The reduced diameter passages and reverse direction of flow which occurs repeatedly along the flow path through the spray head greatly increases the turbulence and turbulent or nearly turbulent flow conditions are achieved in the spray head of the invention. This results in a spray pattern which is more homogeneous and free of voids or reduced spray film thicknesses from that experienced with other conventional airless spray heads. Additionally, the spray head of the invention has been observed to be operable at significantly lower liquid supply pressures than required for conventional airless liquid spray heads. The spray head of the invention greatly reduces and in many occasions eliminates the need for upstream filtering of the liquid being sprayed. Additionally, the spray head of the invention operates at a reduced noise level, from 15 to 20 percent lower decibels than conventional airless spray heads. The spray guard provides an improved venturi action which ensures thorough atomization in mixing of air with the liquid being sprayed.

The invention has been described with reference to the illustrated and presently preferred embodiment. It is not intended that the invention be unduly limited by this disclosure of the presently preferred embodiment. Instead, it is intended that the invention be defined, by the means, and their obvious equivalents, set forth in the following claims:

What is claimed is:

1. In an airless spray head for spraying liquids under high pressure which includes a spray head body having a longitudinal through passage and an orifice tip member with a transverse passage in which is seated an orifice tip and received in said body orthogonally to said longitudinal through passage with said orifice tip positioned in said longitudinal through passage, a retainer to secure said body to a spray gun and seal said body on the discharge end of a spray gun and to seal the interior of said spray head, the improvement comprising: a solids comminuter mounted in said spray head and comprising:

a. a comminuter casing having a liquid inlet end and a liquid discharge end;

b. a turbine mounted within said casing;

c. a comminuting member rotationally mounted in said comminuter casing and mechanically coupled to said turbine;

d. a liquid flow header mounted in said spray head to direct liquid under pressure to said turbine.

2. The airless spray head of claim 1 wherein said turbine and comminuting member are coaxial and mounted on opposite ends of a common shaft which is rotationally received within said comminuter casing.

3. The airless spray head of claim 1 wherein said comminuter casing is received within a tubular spray head housing having a liquid inlet end and a discharge end.

4. The airless spray head of claim 1 wherein said comminuter casing is received in said spray head housing with said turbine mounted adjacent the liquid inlet end and the comminuter member mounted adjacent the liquid discharge end of said housing.

5. The airless spray head of claim 1 wherein said comminuting member is a cylindrical body with a roughened exterior surface.

6. The airless spray head of claim 1 wherein said cylindrical body has a fluted exterior surface.

7. The airless spray head of claim 1 wherein said comminuting member is rotationally mounted within a cylindrical comminuting chamber.

8. The airless spray head of claim 1 wherein said turbine has a drive wheel with a plurality of turbine blades.

9. The airless spray head of claim 1 wherein said flow header includes an annulus between said comminuter casing and said spray head housing and surrounding said turbine.

10. The airless spray head of claim 9 wherein said flow header includes a distributor having an inlet liquid chamber and at least one passage extending from said inlet liquid chamber to said annulus.

11. The airless spray head of claim 9 wherein said distributor has a plurality of radial passages extending from said inlet liquid chamber to said annulus.

12. The airless spray head of claim 9 wherein said comminuter casing has a turbine inlet orifice communicating between said annulus and the interior of said casing and directed obliquely to turbine blades.

* * * * *